United States Patent [19]

Harrington et al.

[11] 3,967,477

[45] July 6, 1976

[54] MULTIPLE DIAL COMBINATION LOCK

[76] Inventors: Richard P. Harrington; Russell J. Harrington, both of P.O. Box 474, Mountainburg, Ark. 72946

[22] Filed: June 27, 1975

[21] Appl. No.: 591,084

Related U.S. Application Data

[63] Continuation-in-part of Ser. No. 479,168, June 13, 1974.

[52] U.S. Cl. ..... 70/131; 70/25; 70/309; 70/315; 70/330; 70/333 R; 292/5

[51] Int. Cl.[2] ..... E05B 37/12; E05B 37/14

[58] Field of Search ..... 70/114, 115, 131, 133, 70/287, 288, 304, 309, 314, 333 R

[56] References Cited

FOREIGN PATENTS OR APPLICATIONS 529,532 11/1940 United Kingdom ..... 70/288

*Primary Examiner*—Albert G. Craig, Jr.
*Attorney, Agent, or Firm*—Jennings B. Thompson

[57] ABSTRACT

A combination lock is disclosed that has a plurality of separately dialed tumblers mounted for rotation around spaced parallel axes. The tumblers extend through openings in a plate and each carries a fence that cannot pass through the opening. Each opening has a lateral gate slot to receive the fence of the tumbler in the opening. The plate must move over the fences to open the lock which it cannot do until the tumblers are positioned so the fences are positioned in alignment with the gate slots. Provision is made for changing the combination when desired and for opening the lock with a master combination when the current combination is forgotten. Also, in one embodiment, the lock can be opened with a spare combination in addition to the master when the current combination is forgotten or lost.

25 Claims, 29 Drawing Figures

FIG. 7
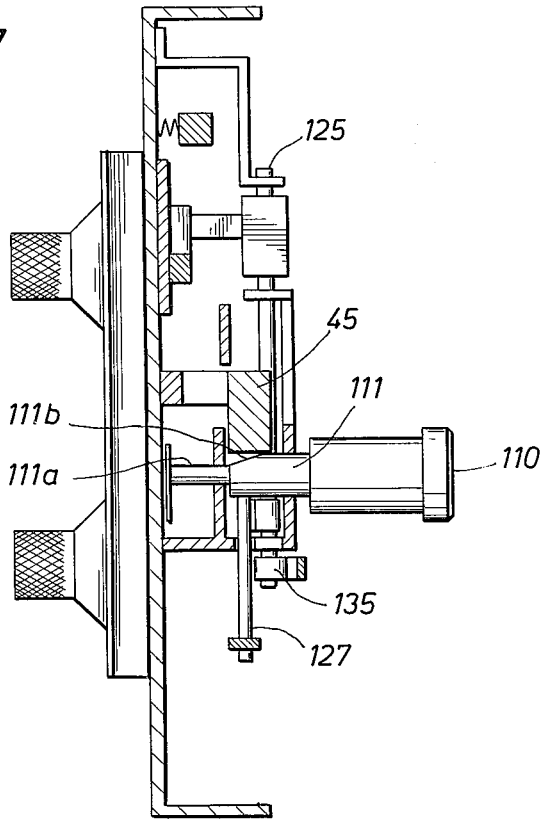
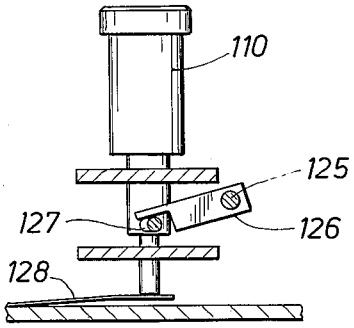
FIG. 8
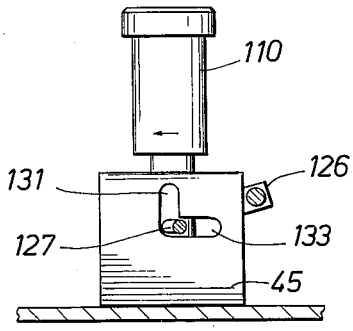
FIG. 9
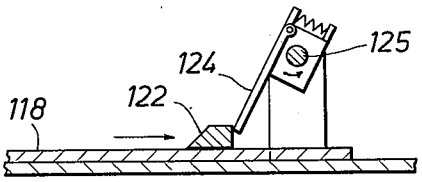
FIG. 10A
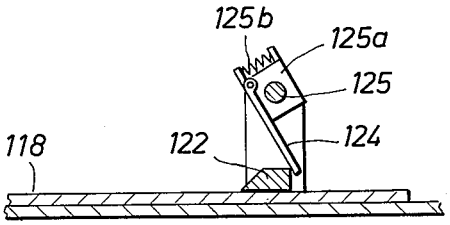
FIG. 10B
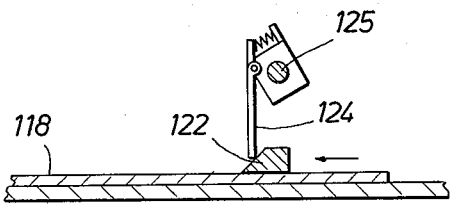
FIG. 10C FIG. 11
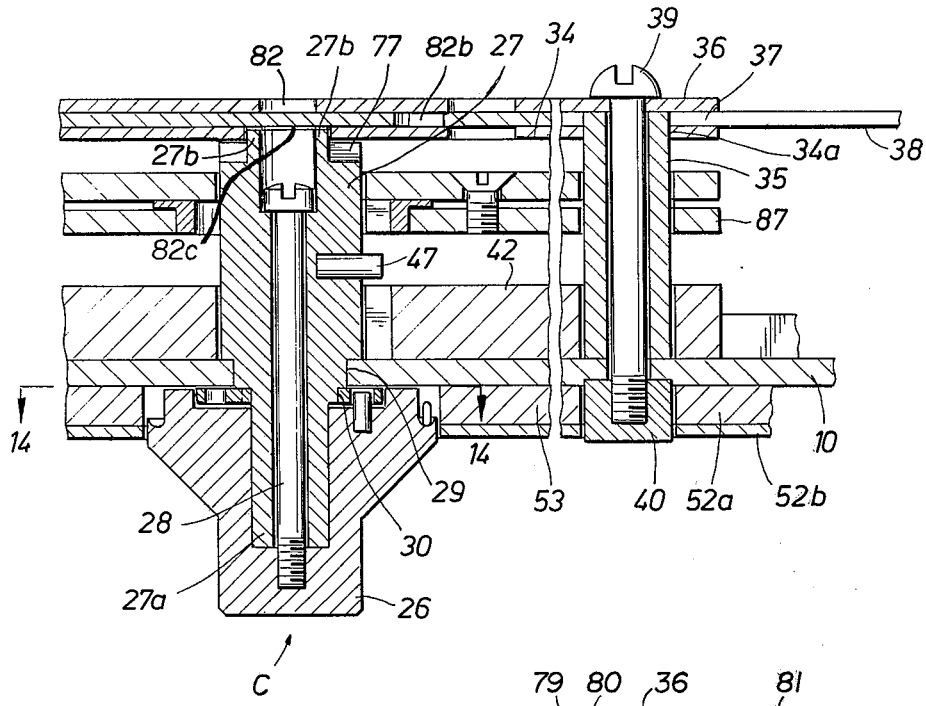
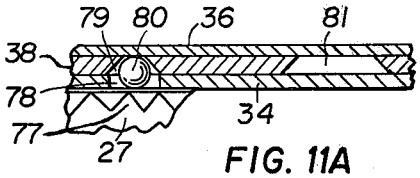
FIG. 11A
FIG. 12
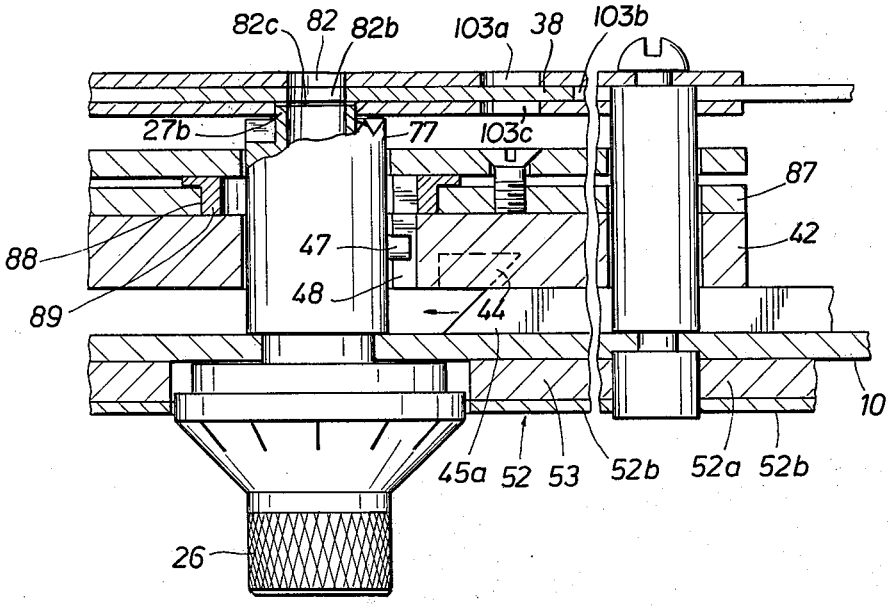

FIG. 13
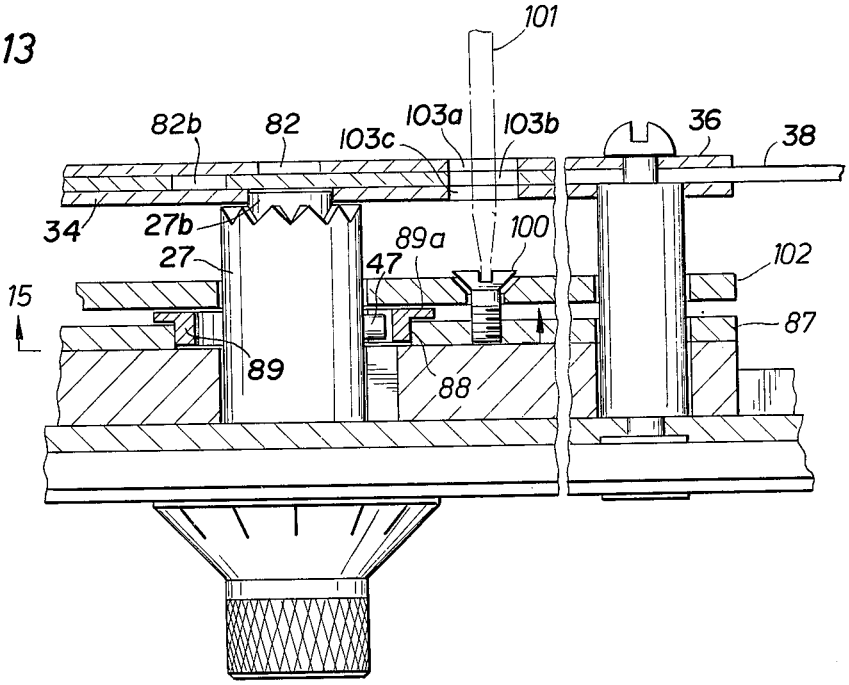
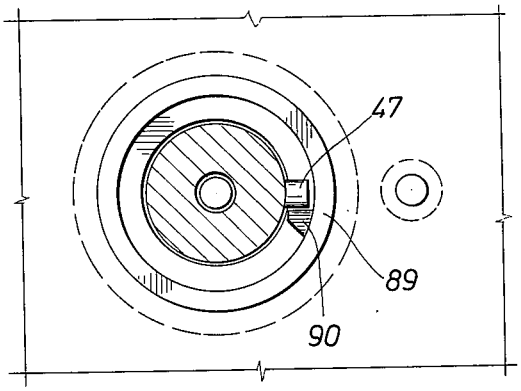
FIG. 15
FIG. 14
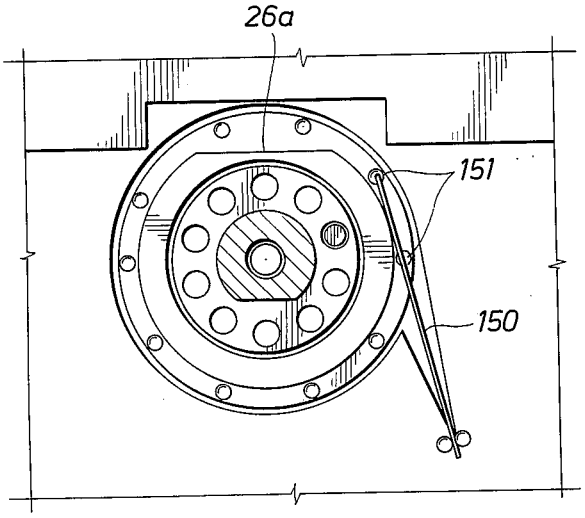

MULTIPLE DIAL COMBINATION LOCK

This is a continuation-in-part of application Ser. No. 479,168, filed June 13, 1974, and entitled MULTIPLE DIAL COMBINATION LOCK.

This invention relates to combination locks generally, and in particular to combination locks that employ a plurality of tumblers, each of which is positioned by an individually adjusted dial.

It is an object of this invention to provide an improved multiple dial combination lock that is reliable in operation and of relatively simple construction.

It is another object and a feature of this invention to provide a multiple dial combination lock that will prevent a pick-lock from learning the combination by the feel or the noise produced by the interaction of the bolt opening mechanism and the tumblers by operating the bolt operating mechanism while rotating the tumblers.

It is a further object of this invention to provide a multiple dial combination lock that can be embodied in either a padlock or a door lock.

Combination locks are useless when the combination has been lost. It is one of the features and an object of this invention to provide a multiple dial combination lock the combination of which can be quickly and easily changed by the owner. With this feature, however, the chances of forgetting the present combination are increased. Therefore, it is another feature of this invention to provide a multiple dial combination lock that has a master combination with which the lock can be opened any time the present or current combination is lost or forgotten. In one embodiment of the invention, an additional or spare combination is available to open the lock should the current combination be lost or forgotten. This spare combination is in addition to the master combination which is always available. The spare combination can be changed if desired by the owner should this be desirable.

These and other objects, features, and advantages of this invention will be apparent to those skilled in the art from a consideration of this specification including the attached drawings and appended claims.

In the drawings:

FIG. 7 is a sectional view taken along line 7—7 of FIG. 3;

FIG. 8 is a sectional view taken along line 8—8 of FIG. 3;

FIG. 9 is a sectional view taken along line 9—9 of FIG. 3;

Figure 2:
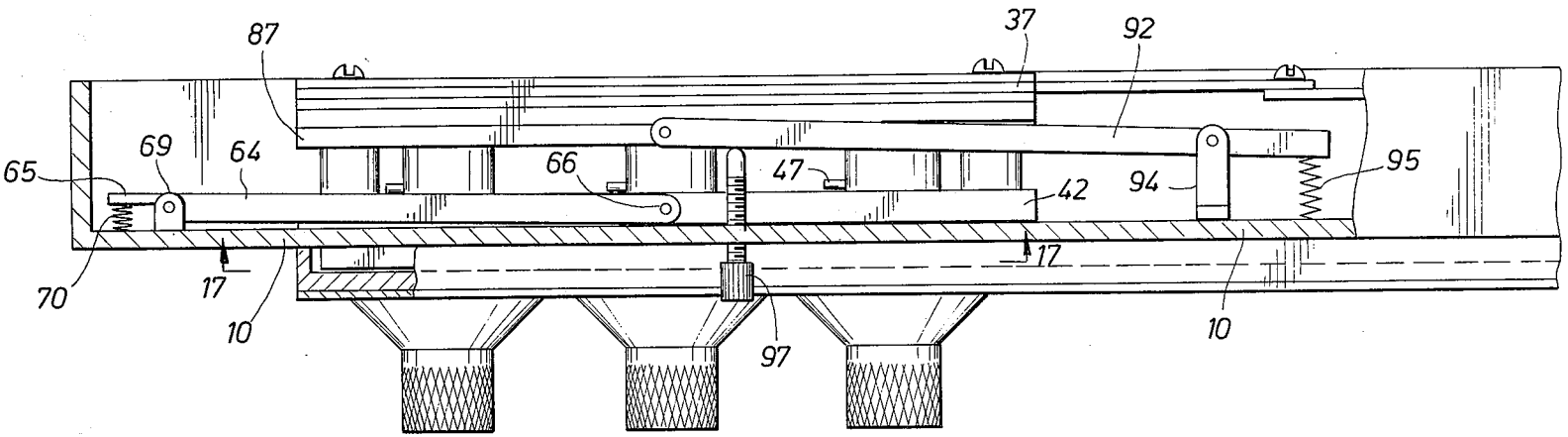
FIG. 2 is a sectional view taken along line 2—2 of FIG. 1.
Figure 3:
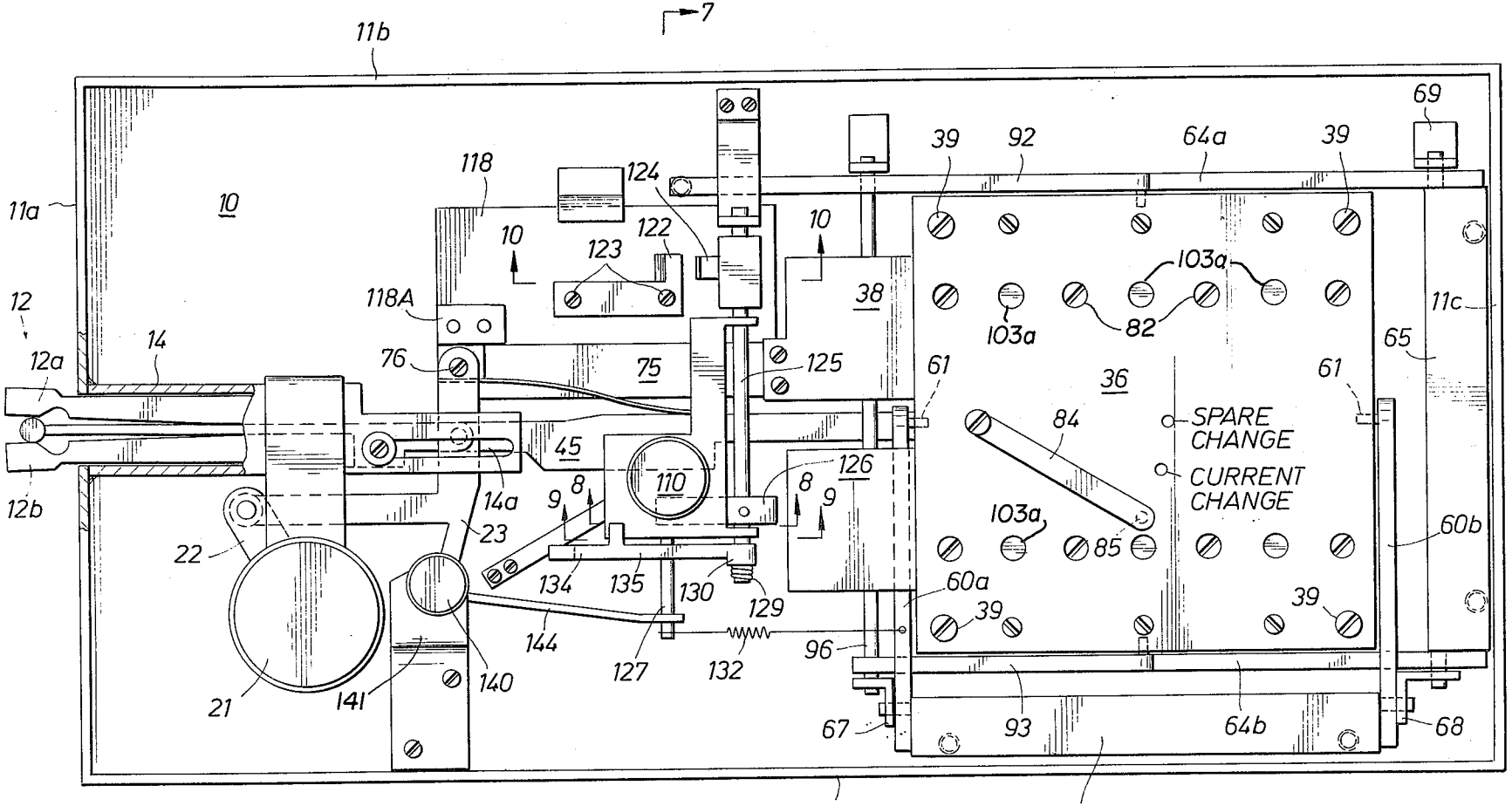
FIG. 3 is a view in elevation of the back or inside of the lock of FIG. 1.
Figure 16:
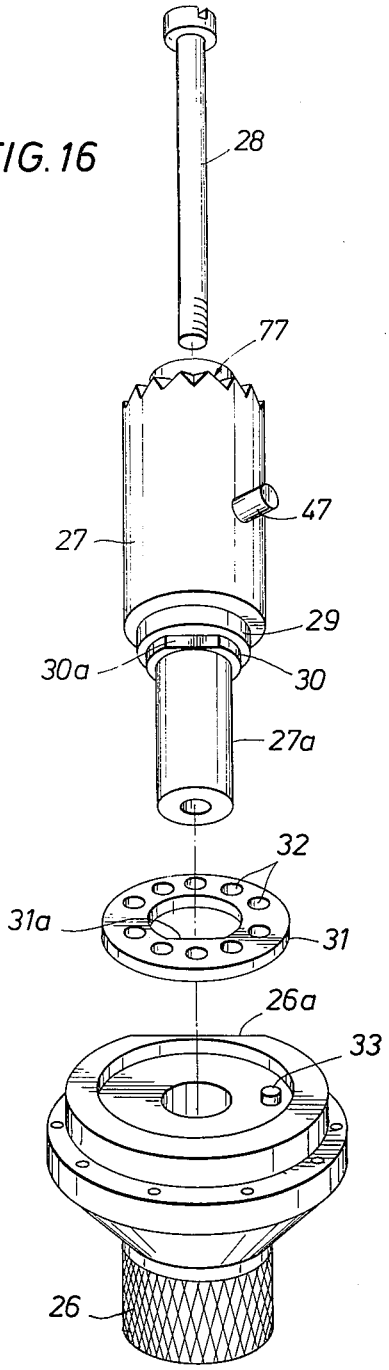
Figure 17A:
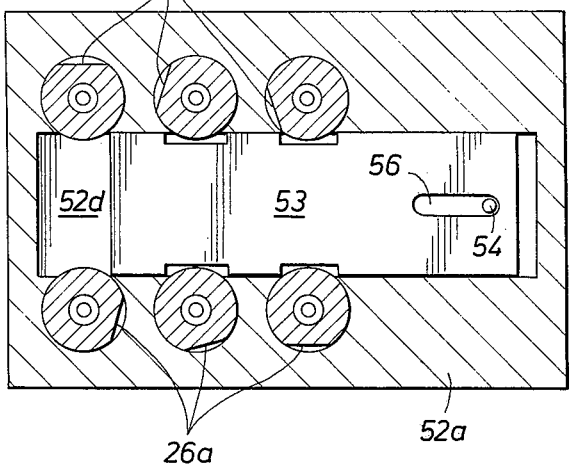
Figure 17B:
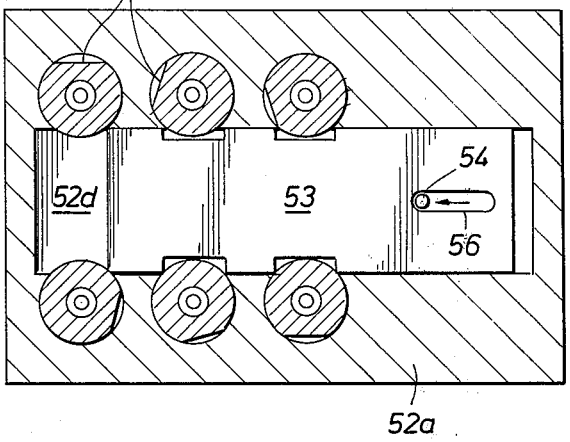
Figure 17C:
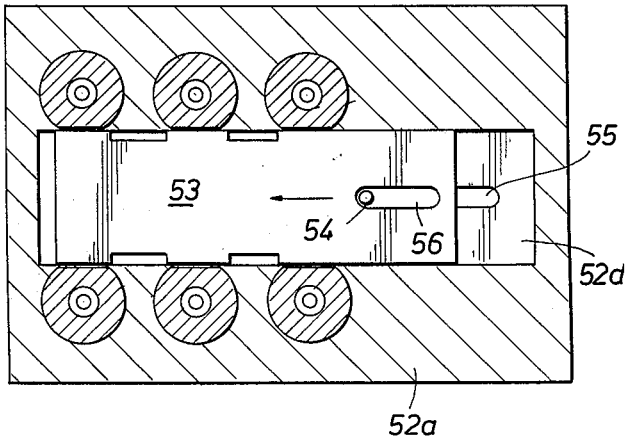
Figure 20:
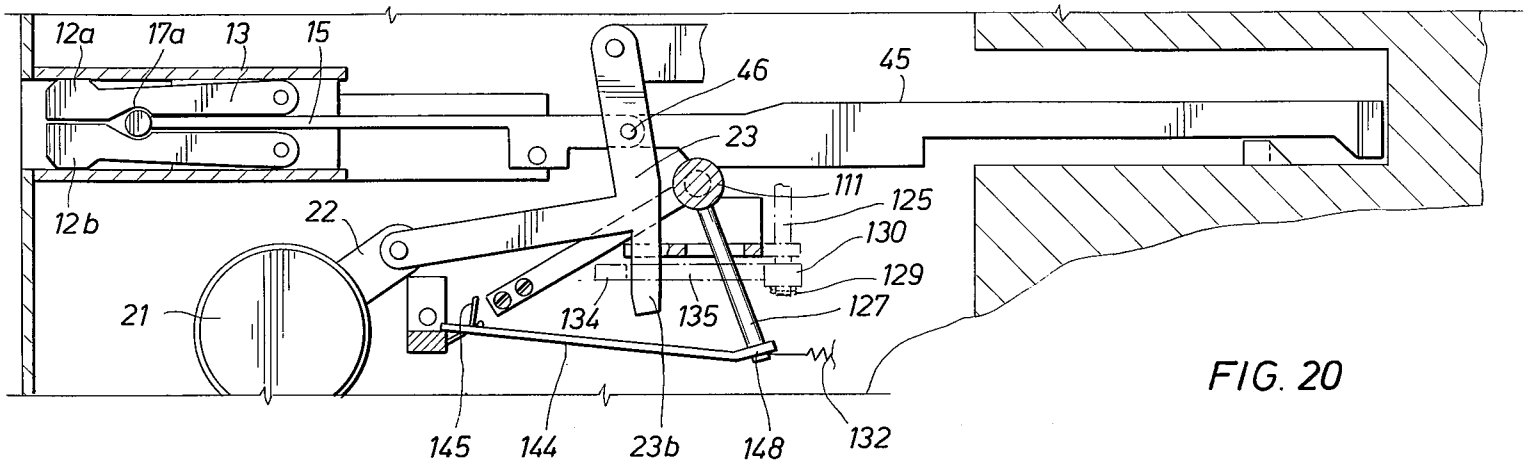
Figure 19:
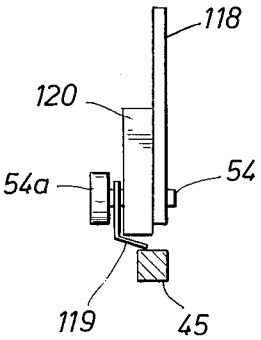
Figure 18:
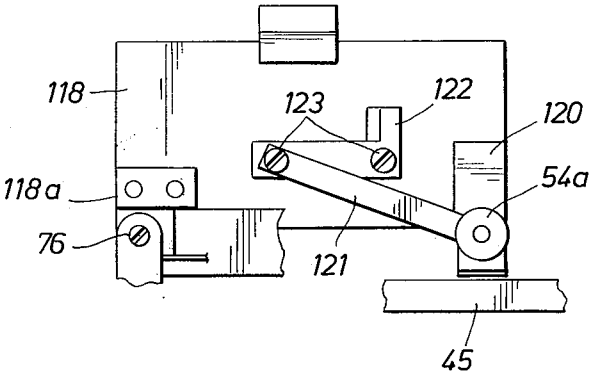
Figure 21:
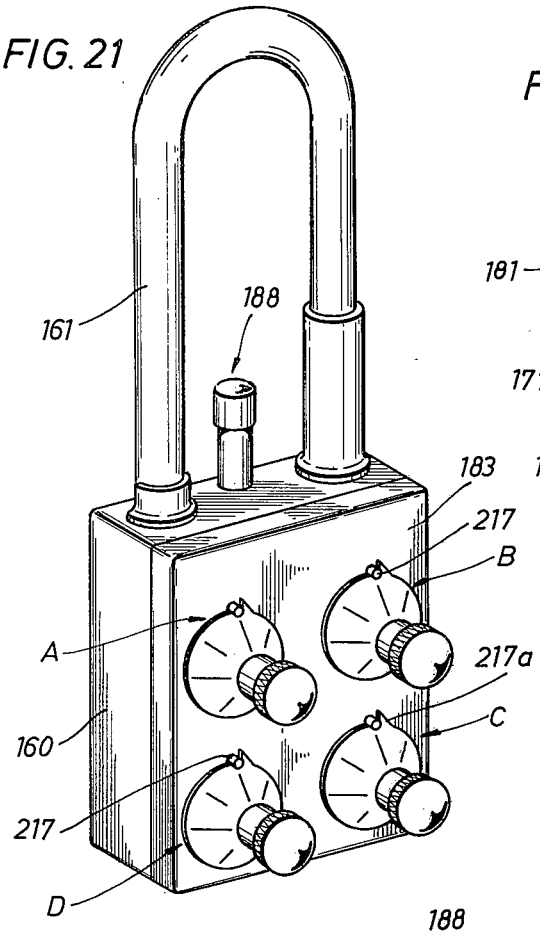
Figure 22:
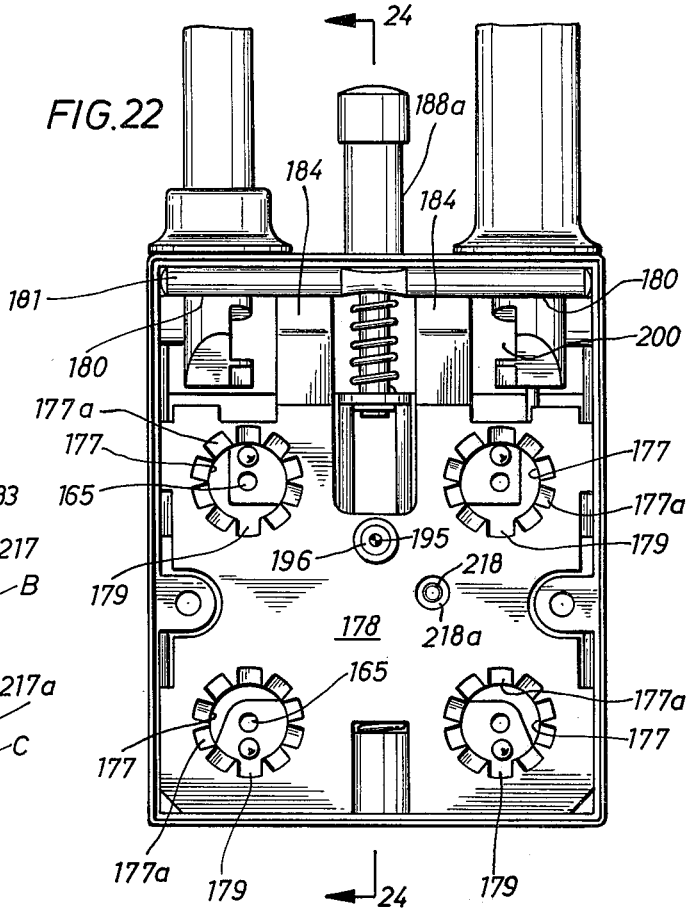
Figure 23:
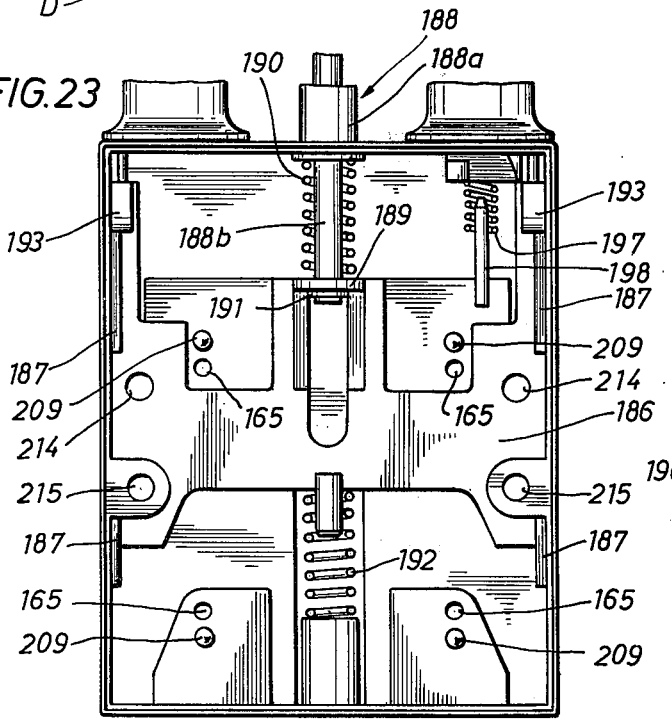
Figure 24:
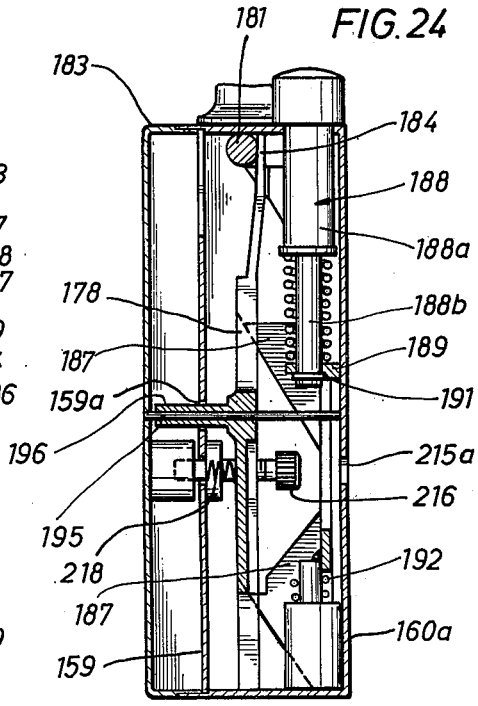
Figure 25:
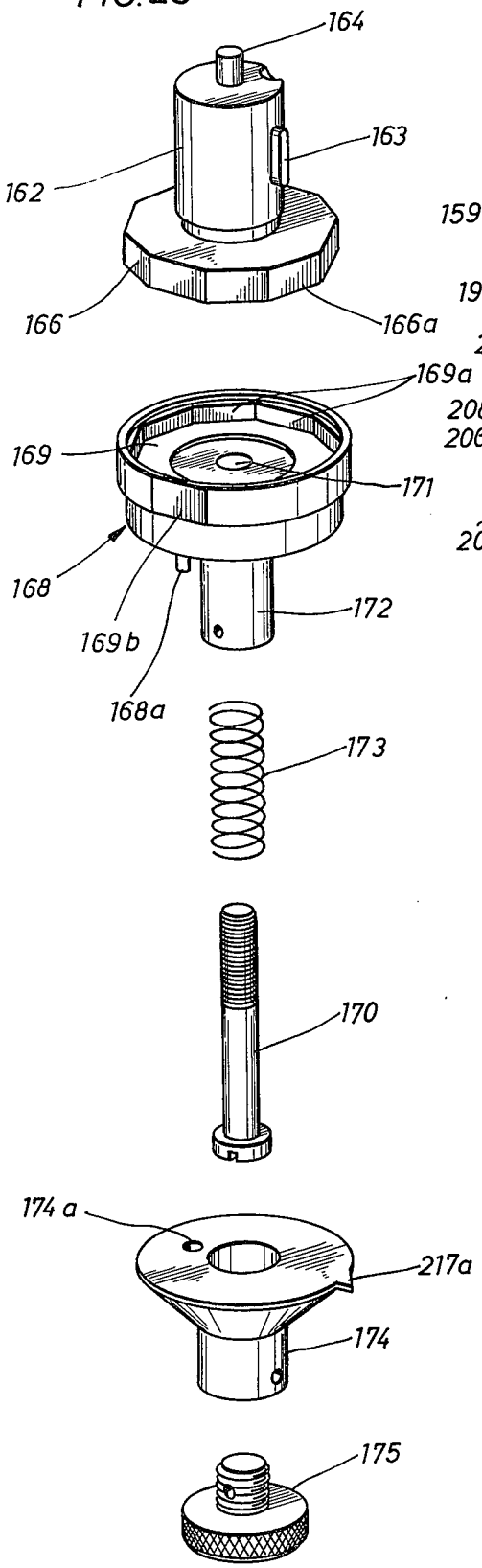
Figure 26:
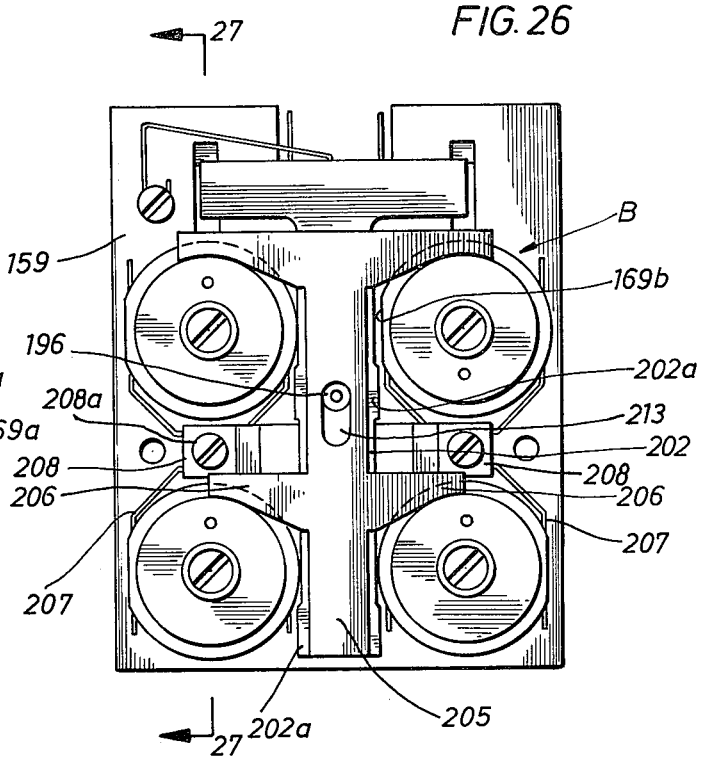
Figure 27:
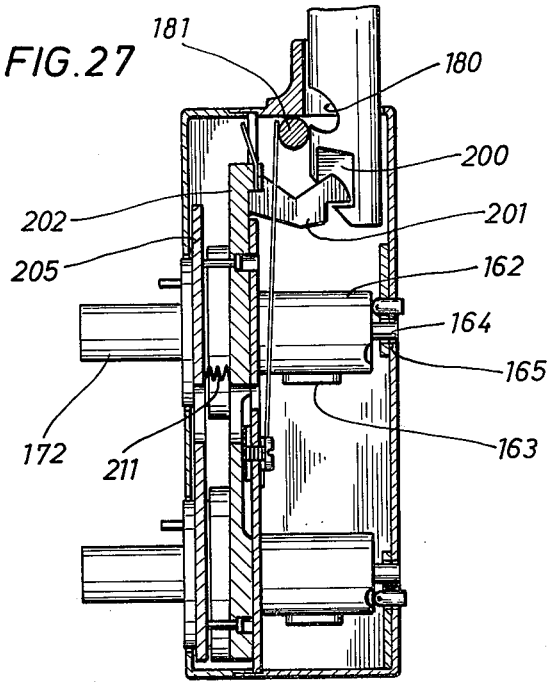
Figure 28:
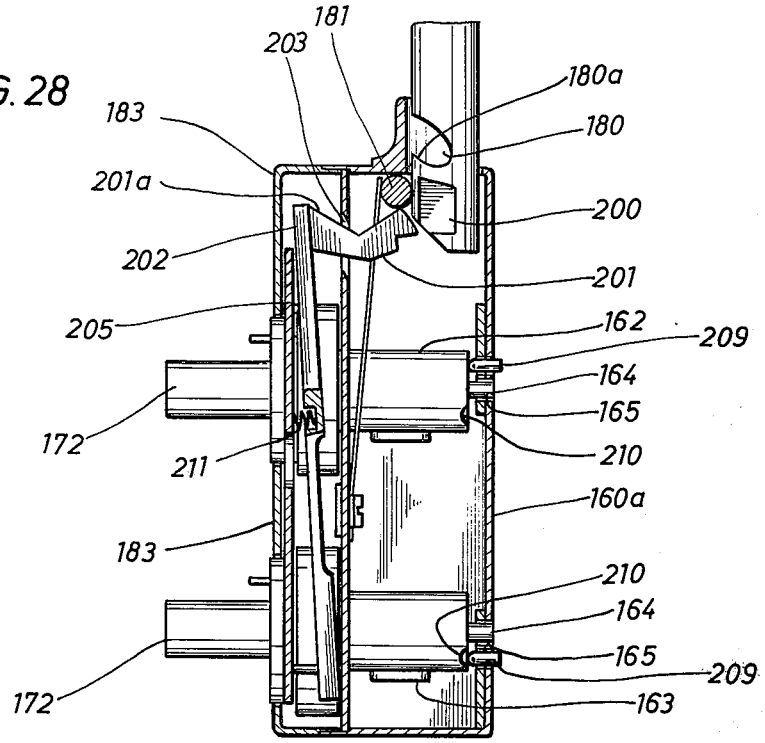
Figure 29:
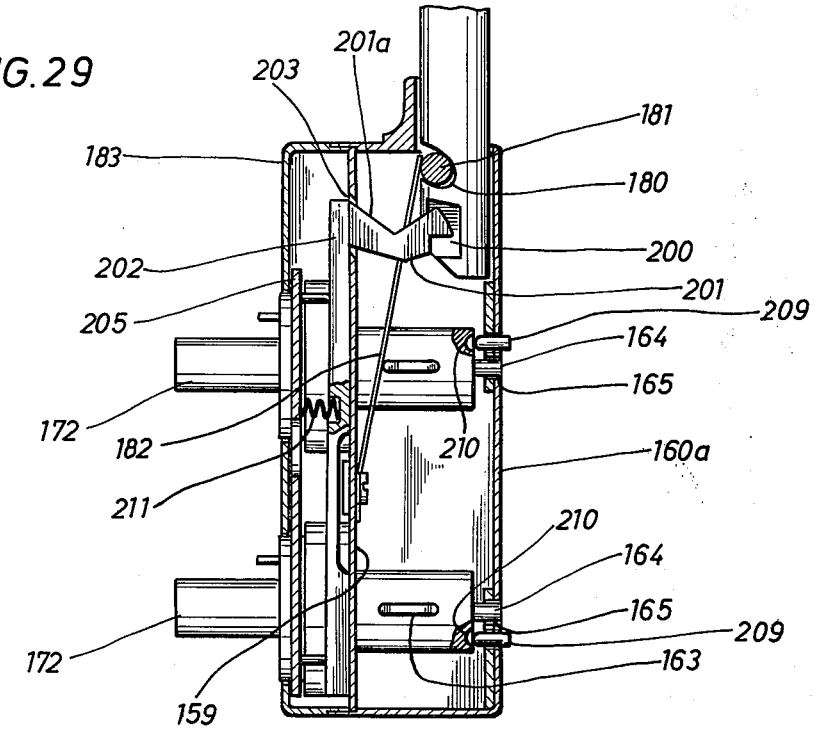

FIGS. 10A, 10B, and 10C are views taken along line 10—10 of FIG. 3 showing the apparatus in different positions;

FIG. 11 is a cross-sectional view through one of the dial and tumbler assemblies of the lock in its locked position;

FIG. 11A is a sectional view of the tumbler locking arrangement;

FIG. 12 is a view similar to FIG. 11, showing the movement of the gate plate as it allows the bolt to be withdrawn from the locked position;

FIG. 13 is a view similar to FIGS. 11 and 12, showing the changing of the spare combination for opening the lock;

FIG. 14 is a view taken along line 14—14 of FIG. 11;

FIG. 15 is a cross-sectional view taken along line 15—15 of FIG. 13;

FIG. 16 is an exploded view in elevation of one of the dial tumbler assemblies;

FIGS. 17A, 17B, and 17C, are sectional views taken along line 17—17 of FIG. 2 showing the different positions of the dials relative to the zero plate of the lock;

FIG. 18 is a plan view of a portion of the mechanism for allowing the lock to be opened from the inside;

FIG. 19 is a side view of the apparatus of FIG. 18;

FIG. 20 is a view in elevation similar to FIG. 3 of the bolt mechanism in the open position;

FIG. 21 is an alternate embodiment of the lock of this invention adapted for use in a padlock;

FIG. 22 is a sectional view through the lock showing a plan view of the gate plate with the tumblers removed;

FIG. 23 is a sectional view similar to FIG. 22 except on a different plane showing the apparatus for moving the gate plate to open the lock;

FIG. 24 is a sectional view taken along line 24—24 of FIG. 22;

FIG. 25 is an exploded, isometric view of a tumbler;

FIG. 26 is a sectional view showing a plane veiw of the zero and combination change plate;

FIG. 27 is a sectional view taken along line 27—27 of FIG. 26; and shows the first opening stage;

FIGS. 28 and 29 are sectional views showing the lock in second or open stage and the locked position.

The door lock embodiment shown in FIGS. 1 through 20 will be described first.

Figure 1:
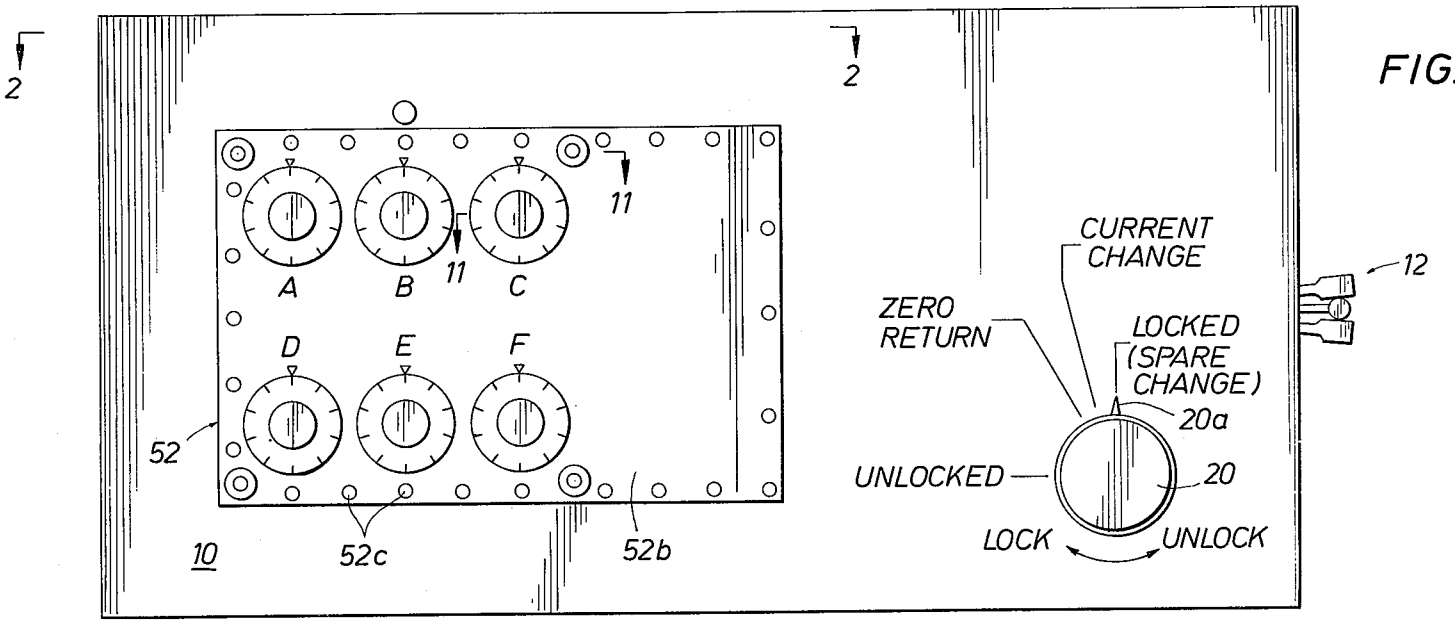
FIG. 1 is a view in elevation of the front of a door lock that embodies the lock of this invention, the lock is shown without the door or door jamb.

As shown in FIGS. 1 and 3, the housing for the lock includes front plate 10 and side plates **11*a*–11*d*. The front plate and the side plates are shown integrally connected together to form a rectangularly shaped housing to support the lock and to allow the lock to be mounted in a door (not shown). Bolt assembly 12 extends through an opening in side plate 11*a*** to extend into an opening provided therefor in the door jamb when the lock is in its locked position to hold the door from being opened.

Figure 4:
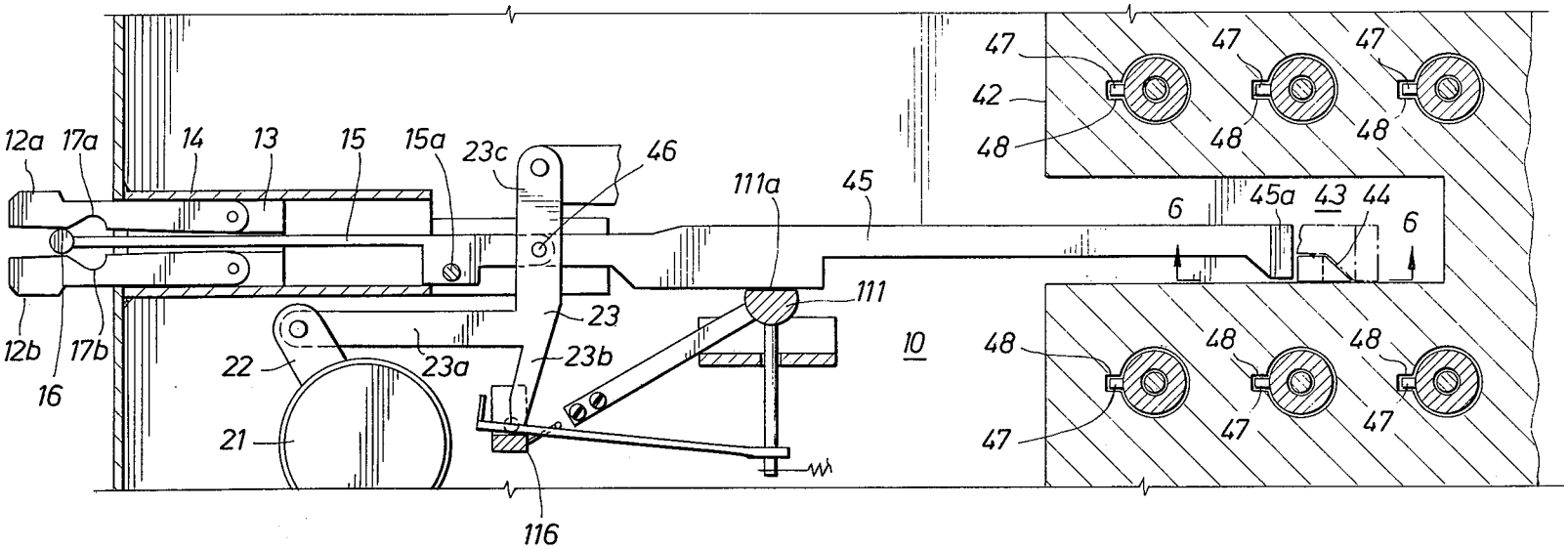
FIG. 4 is a view from the back of the lock of FIG. 1, partially in elevation and partially in section, to show the tumbler and gate positions when the lock is ready to be opened.

Although any type bolt may be used with this lock, in the embodiment shown bolt 12 is of the split type, having portions **12*a* and 12*b*, as shown in FIG. 4, that are pivotally mounted to slide block 13 located in bolt guide 14. Rod 15 extends between the two portions of the bolt and carries knob 16 which forces the two bolt portions apart to expand the bolt when it is in the recess provided therefor in the door jamb. To retract the bolt, rod 15 is moved to the right by the bolt retracting mechanism to be described. This pulls knob 16 into slots 17*a* and 17*b*, allowing the two halves of the bolt to pivot toward each other. Knob 16**, then, engages the back of the slots and pulls the two bolt halves out of the door jamb and to the right to unlock the door.

Figure 5:
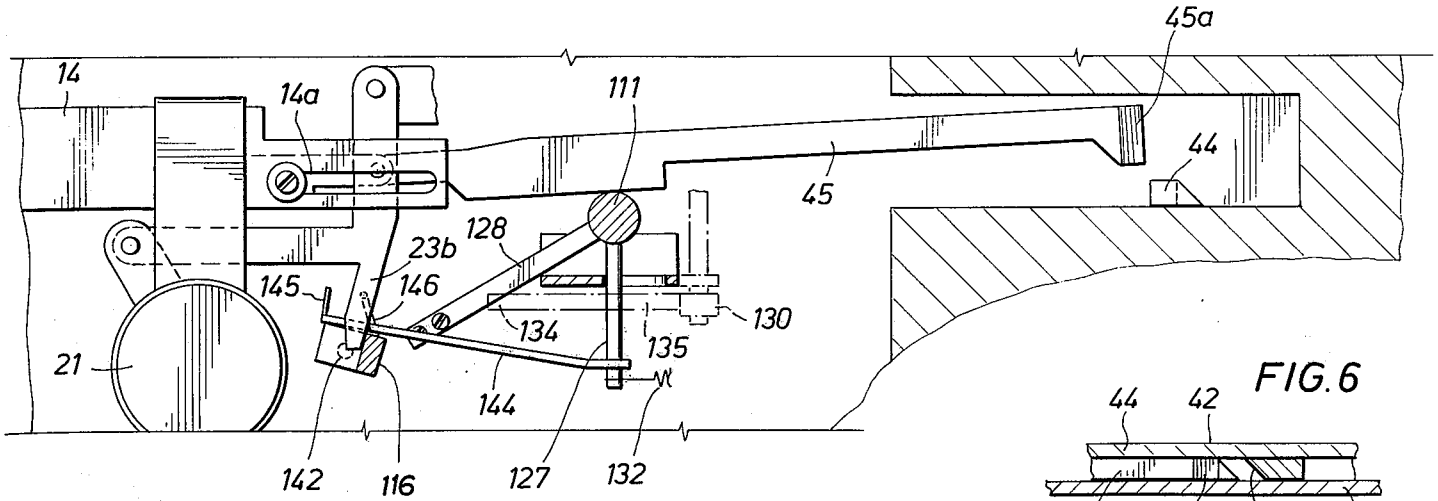
FIG. 5 is a view similar to FIG. 4, showing how the lock can be opened from the inside by bypassing the bolt holding means or gate plate of the lock.

The means for moving the bolt between a locked and unlocked position, include outer knob 20 and inner knob 21 which are mounted on a common shaft that extends through front plate 10 of the housing. Also attached to the shaft (not shown) for rotation therewith is arm 22 which is pivotally connected to bracket 23 by link 23*a*. The bracket includes arm 23*b* which is a portion of the night latch feature of the lock, which will be explained below. Portion 23*c* of the bracket is pivotally connected to the end of bolt rod 15. Rotation of either of knobs 20 or 21 will rotate arm 22 and through bracket 23 move bolt rod 15 and the bolt left or right, as viewed in FIG. 4. To help guide the rod in its movement, guide pin 15*a* extends through the rod and rides in grooves 14*a* of bolt guide 14, as shown in FIG. 5.

In FIG. 1, knob 20 is shown carrying pointer 20*a*, which moves between four index marks as the knob is rotated to indicate the position of the bolt. Each of the four index marks are labeled. As shown, the knob is opposite the mark label "locked (spare change)". It is moved counterclockwise to the unlocked position. There are two intermediate positions- "zero return" and "current change". This, along with the meaning "spare change" will be explained below.

In accordance with this invention, the lock includes a plurality of cylindrical tumblers mounted for rotation around their longitudinal axes, each tumbler includes a graduated dial for indicating the position of the tumbler relative to a reference point. In the embodiment shown, six such tumblers are used. They are identified by the letters A–F. Each tumbler is structurally the same as the other, and functions in the same way. Therefore, only one will be described in detail.

As shown in FIGS. 11 and 16, tumbler C includes dial portion 26 and barrel portion 27. Machine screw 28 extends through barrel 27 and engages a tapped hole in dial 26 to connect the dial to the barrel. The barrel has nose portion 27*a* of reduced diameter upon which dial 26 is mounted. Two other areas of reduced diameter provide annular surface 29 that extends through an opening in plate 10 to locate the barrel in the desired position in the housing. Annular surface 30 supports disc 31 having a plurality of perforations 32. Surface 30 has milled flat 30*a* that engages flat side 31*a* of the opening through disc 31 to provide a driving connection between barrel 27 and the disc. Pin 33 attached to the dial engages one of perforations 32 in the disc to provide a driving connection between the dial, the disc, and the barrel of the tumbler assembly.

Barrel 27 is held in position by bearing plate 34. The tumbler has portion 27*b* that extends into an opening in the plate to hold the tumbler against lateral movement. The plate, in turn, is held against lateral movement by cylindrical spacers 35 that are positioned between front plate 10 and back plate 36 and extends through opening 34*a* of the plate. Spacers 37 are positioned between back plate 36 and plate 34 on opposite sides of plate 38 to provide a space between plates 34 and 36 in which is located detent plate 38. Spacers 37 are thicker than plate 38 and extend the length of back plate 36 on opposite sides of plate 38 to guide this plate as it reciprocates during operation of the lock. Machine screw 39 extends through spacer 35, back plate 36, and spacer 37 and cooperates with nut 40 to mount these members on front plate 10. Four such spacer machine screw assemblies are provided, one located at each corner of back plate 36, as shown in FIG. 3 where the heads of bolts 39 can be seen.

Figure 6:
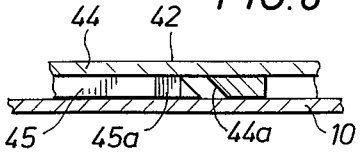
FIG. 6 is a sectional view taken along line 6—6 of FIG. 4.

Positioned just on the inside of front plate 10 is gate plate 42. This plate has six openings, as shown in FIG. 4, through which the barrels of the tumblers extend. The plate has slot 43 in it, with cam portion 44 attached to the plate and extending into the slot. As shown in FIGS. 4 and 6, cam 44 is positioned to engage one end of bolt control member 45, when the bolt is moved to the right. The control member is connected to bolt bracket 23 by pin 46. End 45*a* of the member is beveled, as shown in FIG. 6, to engage beveled surface 44*a* of cam 44 and urge the gate plate 42 to move upwardly. If the plate and cam cannot move upwardly, then they will hold bolt rod 45 from movement to the right as viewed in FIG. 4, and the bolt and the lock cannot be opened.

Plate 42 is mounted, as shown in FIGS. 2 and 3, for movement toward and away from front plate 10. In the embodiment shown, pivot arms 60*a* and 60*b* are located on opposite sides of the plate. One end of each arm is pivotally connected to the plate along a common axis by pins 61. Cross bar 62 extends between the arms and rigidly connects the arms to force the arms to move together. Pivot arms 64*a* and 64*b* are located on opposite sides of the plate also with one end connected to the plate by pins 66, only one pin being shown, that have a common axis that is perpendicular to the axis of pins 61. Cross bar 65 is rigidly connected to the arms to insure common movement. Thus, the center of each side of the plate is pivotally connected to one of the pivot arms. The other ends of the arms 61*a* and 61*b* are connected to one leg of L-shaped lugs 67 and 68 by pivot pins. Arm 64*b* has its other end connected to the other leg of lug 68. The other end of arm 64*a* is pivotally connected to lug 69. Springs, such as spring 70, are positioned between cross bars 62 and 65 and front plate 10 to urge the arms to move the plate toward front plate 10 at all times. This is the first or bolt holding position. It is moved away from the plate, as will be explained below, to its second position when the lock is opened. The pivot arms are designed to insure that as the plate moves, it will remain generally parallel to the front plate.

To control the opening of the lock, each barrel of the six tumblers is provided with laterally extending fence 47. Also, each opening in gate plate 42 through which the barrels extend is provided with slot 48 providing a gate through which each fence can move when the fence and gate are aligned. This occurs when the proper combination is set on the dials of the tumblers A–F. As shown in FIG. 4, the proper combination has been dialed and each fence 47 is positioned in alignment with one of gates 48 in plate 42. Thus positioned, rotating knob 20 toward the unlocked position will cause the outer end of bolt control member 45 to move into engagement with cam 44 and urge plate 42 away from front plate 10. Since the gates can move over the fences, the plate can so move allowing member 45 to move to the right past cam 44.

In accordance with another feature of this invention, the combination of the lock cannot be left exposed when the lock is open because means are provided to require the dials to be returned to a preselected index before the lock can be opened after the proper combination has been dialed. As explained above, rotating knob 20 in a counterclockwise direction when the proper combination has been set on the dials will cause the end 45*a* of bolt control member 45 to move past cam 44. As shown in dotted lines in FIG. 4, when index or pointer 20*a* of the dial reaches the mark zero return, the end of rod 45 will have cleared cam 44, and plate 42 will be moved by springs 70 back to its original position shown in FIG. 11, where it is out of engagement with fences 47. While the plate was in its second position allowing member 45 to move by cam 44, the fences are positioned in the gates and the dials, of course, could not be rotated. Once the end of the control rod 45*a* has cleared the cam and the plate is moved back to its position shown in FIG. 11, then the dials are free for rotation. At this point, all the dials must be returned to a preselected position before the lock can be completely opened. In the embodiment shown, the dials must be returned to zero.

Mounted on the front of plate 10 is zero plate housing 52 comprising guide plate 52*a* and cover plate 52*b*. This housing has the proper openings to receive nuts 40 and dials 26, as shown in FIG. 11, and is attached to front plate 10 by a plurality of machine screws 52*c*. It also has an internal cavity 52*d* formed by a slot in guide plate 52*a* in which is located zero plate 53. As shown in FIGS. 17A–17C, zero plate 53 can slide a limited distance to the left and right. Pin 54 is connected to the bolt mechanism in a manner to be described below and extends through clearance or access slot 55 in front plate 10 into slot 56 of the zero plate. Initially, when the bolt is in the locked position, pin 54 is located at the righthand end of slot 56, as shown in FIG. 17A. Movement of the bolt to the zero return position moves pin 54 to the opposite end of slot 56, as shown in FIG. 17B. No movement of the zero plate has occurred at this time. Any further opening of the bolt, however, will require movement of the zero plate to the left. Each dial 26 has flat 26*a* that lies in the same plane as zero plate 53. As shown in FIG. 17A, the dials appear, for example, as when the combination has been dialed and the lock is ready to open. The knob 20 has been rotated to allow cam end 45*a* of the bolt control member to clear cam 44 and now plate 42 is dropped back out of engagement with pins 47 and the knobs are free to rotate. Further opening of the lock cannot be accomplished, however, because zero plate 53 cannot clear the cylindrical surface of the knobs, as shown in FIGS. 17A and 17B. Therefore, at this point, all knobs must be returned to zero or some other selected index number, which positions all the flats, as shown in FIG. 17C, to allow the movement to the left of zero plate 53. Now the lock can be opened completely, but in doing so the combination of the lock is not exposed to someone who might pass by while the lock is in the open position.

It is one of the features of this invention that any attempt to "feel" or "hear" the combination of this lock is prevented. To accomplish this, means are provided to lock the dials against rotation at any time that pressure is applied to the bolt urging it toward an open position. In the embodiment shown, and as best seen in FIGS. 3, 11, 11A, and 12, detent plate 38 is mounted to slide between back plate 36 and plate 34. Plate 38 is connected to bolt bracket 23 by length 75 and pin 76. The end of barrel 27 of each of the tumblers is provided with a plurality of serrations or notches 77. Positioned in hole 78 in bearing plate 34 is locking ball 80 which is held from side movement by the side walls of the hole. A similar hole and ball arrangement is located adjacent the serrated end of each tumbler. When, as shown in FIG. 3, the bolt is all the way closed, then the position of ball 80 is as shown in FIG. 11A and the ball is free to move into chamfered hole 79 in the detent plate and the tumbler is free to rotate. Any pressure exerted on the bolt attempting to move the bolt to the right, as shown in FIG. 3, will move detent plate 38, and, as viewed in FIG. 11A, this movement will be to the left. There will usually be sufficient slack in the bolt operating mechanism that some movement in the mechanism can occur when pressure is applied to opening knob 20. This movement, however, will be sufficient for the chamfered edge of hole 79 in the detent plate to move ball 80 through opening 78 into engagement with one of the slots or serrations 77. Part of the ball will remain in opening 78. Thus, the ball will lock the tumbler against rotation. Therefore, any attempt to feel or hear the combination by manipulating the dials while holding pressure urging the bolt open is prevented. When the proper combination has been dialed and the bolt is being opened, elongated slot 81 will move to a position to receive ball 80 and allow the dials to be rotated to the zero or preselected position and remove the combination from the dials. Before the opening knob reaches the zero return point, however, balls 80 will continue to keep the dials locked against rotation even though they cannot be rotated because fences 47 are located in gates 48. The balls, however, provide a very positive lock to prevent any damage being done to the fence or the gate by attempting to force rotation during this period.

Means are provided to change the current combination of the lock whenever this is desired. To change the combination, the proper current combination is dialed and the bolt actuating knob 20 moved to place index 20*a* in line with current change, as shown in FIG. 1. In this position, the elements are as shown in FIG. 12. Fence 47 is located in gate 48, which holds the tumbler against rotation and, as explained above, the tumbler is also being held against rotation by ball 80. In this position, opening 82*a* in the back plate, 82*b* in the detent plate, and 82*c* in the bearing plate are in alignment and allow access to bolt 28. A screwdriver can be inserted through these openings and bolt 28 loosened allowing knob 26 to be repositioned to any desired number. For example, in FIG. 1, the combination beginning with tumbler A, is 667399. By loosening the bolt of each tumbler, each individual dial can be reset to any number desired, the bolts tightened, and the lock has a new combination.

Means are provided to hold the lock in current change position while this is being accomplished. As shown in FIG. 3, two openings are provided in back plate 36 labeled spare change and current change. Spring arm 84 is pivotally mounted to back plate 36 and carries pin 85 designed to engage the spare change and current change openings. Corresponding openings are located in plate 38 so that when the lock is moved to current change position, spring arm 84 can be pivoted into position for pin 85 to enter the opening labeled current change, and also enter an opening in alignment therewith located in plate 38. This effectively locks the lock in the current change position until such time as the combination has been changed, after which pin 85 can be lifted out of engagement with the openings in the plates and the lock can be opened or closed as desired.

It is one of the features of this embodiment of the invention to provide a spare combination for the lock that can be used in case the current combination is forgotten or lost. To accomplish this in accordance with this invention, means are provided whereby the dials of the lock can be positioned against a stop and then moved in a given direction a predetermined number of increments, and the lock can be opened. In the embodiment shown, spare combination plate 87 is located parallel to gate plate 42 and between the gate plate and the back plates of the lock. The spare combination plate has openings 88 for each of the tumblers. Mounted in each opening is annular stop ring 89, having inwardly extending stop 90. The inside diameter of stop ring 89 is sufficient to receive the barrel of the tumbler along with fence 47. Shown in FIG. 15, however, stop 90 will engage fence 47 and stop its rotation.

To use the spare combination, spare combination plate 87 is allowed to move toward the front plate until the fence of each tumbler is located inside one of the stop rings. To allow such movement in the embodiment shown, spare combination plate 87 has pivot arms 92 and 93 located on opposite sides thereof with their ends pivotally connected to the plate along a common axis. The other ends of arms 92 and 93 are mounted on shaft 96 which extends through lug 94 and the other leg of L-shaped bracket 67. Lug 94 is attached to front plate 10. A portion of arm 92 extends beyond lug 94 to permit coil spring 95 to continuously urge the arm to pivot so as to move the plate toward front plate 10. In a position shown in FIG. 2, thumb screw 97, which is mounted on a tapped hole in front plate 10, is in engagement with spare combination plate 87 and holds it so that it is well spaced from the fences carried by the tumblers. To use the spare combination, thumb screw 97 is released to allow spring 95 to move the spare combination plate toward the front plate until fences 47 are located inside the stop rings of the plate. Then, each knob is rotated in a preselected direction, say to the right or clockwise, until the fence on the tumbler engages the stop in the stop ring. With all of the knobs in position with their tumblers engaging the stops, the spare combination is then applied to open the lock. The spare combination is a set of numbers that are not to be set on the indexes but to indicate the number of increments the dial is to be rotated away from the stop. Once the dials have all been moved against the stop, the numbers that the dials read is known as a spare or subnumber combination, which we will discuss more about later. Anyway, after the knobs have been so positioned, thumb screw 97 is tightened up to move the spare combination plate 87 back to its original position, as shown in FIG. 2. To open the lock, then, say for example, the spare combination is 623010, then dial A is moved six digits, dial B two digits, dial C three digits — these digits we are talking about, for example, is if dial C was located indicating the number 4, then it would be moved three digits counterclockwise until the number 7 appeared. The spare combination is then dialed and this will produce on the dial faces the actual current combination which, of course, is a necessary result, but at least the lock can now be opened.

The relationship of the current, spare and subnumber combinations is as follows. By subtracting the spare combination from the current combination, the subnumber combination is obtained. Conversely, adding the spare to the sub will produce the current, so that if any two are known, the other can be found.

If both the current and the spare are misplaced, lost or forgotten, the lock can still be opened by using a master combination. It is contemplated that this master combination would only be supplied to the purchaser of the locks and possibly to locksmiths, and each lock would have its own master combination. The master combination is based upon the relationship between fence 47 and flat **30*a* on the tumbler, as shown in FIG. 16. This relationship is fixed at the factory. The factory also knows the position of each gate. Therefore, the owner or locksmith can insert a thin piece of shim stock above each tumbler between the dial and front plate 10. The shim stock must extend past perforated ring 31 and annular surface 29 to engage annular surface 30. Sufficient clearance is provided for this to occur, using very thin shim stock material. The dials are then rotated until the locksmith can feel that flat 30*a* is facing upwardly or in whatever selected direction it is desired. Then, with all of the tumblers so positioned, fences 47 and gates 48** have a definite relationship and with the master combination the locksmith can rotate the tumblers to position the fences in alignment with the gates and open the lock. Once the lock has been opened, of course, the current combination can be reset to any desired number.

In addition, the spare combination can be changed when desired. Referring to FIG. 13, holding screws 100 are shown being loosened by screwdriver 101. These screws release the clamping pressure exerted on flange **89*a* of stop ring 89 by plate 102. It is the purpose of screws 100 and plate 102 to clamp flange 89*a* between this plate and spare change plate 87 to hold the stop rings from rotation. By loosening screws 100, the ring is free to move in the opening. By releasing thumb screw 97, spare change plate 87 will move to the position shown in FIG. 13. In this position, openings 103*a*, 103*b*, and 103*c* will be aligned through the back set of three plates, as shown in FIG. 13, to allow access to holding screws 100. There will, of course, be more than one. By loosening these screws, rotation of the tumblers will cause the fence in engagement with stop 90** to move the stop to another position. The new position for each of the tumblers should be carefully recorded, because from this the spare combination is obtained. In other words, after the dials have all been set changing the position of the stops, the numbers on the dial should be read with the fences in engagement with the stops. This number, then, is subtracted from the current combination to produce the spare combination. No numbers are carried over in this computation. For example, if the current combination is 667399, and the subnumber reads 044389, after the spare combination has been changed, then the spare combination is 623010 which is obtained by subtracting the subnumber from the current combination.

This lock is provided with an inside release knob to allow the lock to be opened, regardless of the setting of the knobs, when it is desired to get out of the inside of a room. This will prevent someone from being inadvertently locked inside of a door. In FIG. 7, knob 110 is mounted on shaft 111. When the knob is all the way out, i.e., to the right, as viewed in FIG. 7, bolt control member 45 is supported on flat **111*a*, as shown in FIG. 4. In this position, it is in alignment with cam 44, so that unless the proper combination has been dialed the lock cannot be opened. By moving knob 110 inwardly, inclined surface 111*b* will pivot bolt control member 45 to the position shown in FIG. 5 and rotation of bolt control knob 21 will move the bolt to the unlocked position since righthand movement is not prevented by cam 44**.

Before the bolt can be moved, however, means must be provided to disable the zero plate assembly since unless all the dials happened to be on zero, this assembly would prevent the lock from being opened from the inside. In the embodiment shown, headed pin 54, which engages the slot in the zero plate, is mounted for movement with the bolt, as shown in FIGS. 18 and 19. It extends through an opening in plate 118 and through guide block 120. The plate is attached to the bolt mechanism for movement therewith by bracket 118*a* and pin 76 (FIG. 3). Pin 54 includes head 54*a* extending out beyond lift lever 119. Lever 119 is positioned to be engaged by bolt control member 45 when it is pivoted upwardly by knob 110. Upward movement of the control member pivots lever 119 counterclockwise, as viewed in FIG. 19, causing it to engage head 54*a* and move pin 54 to the left, as viewed in FIG. 19, and out of engagement with the slot in the zero plate. This effectively bypasses the zero plate and allows the bolt to be moved to the open position, as viewed in FIG. 20. When the bolt is returned to the locked position, spring 121 bearing against head 54*a* will move pin 54 back into engagement with the slot in the zero plate.

The lock also includes an automatic lock back feature, i.e., when moved to the unlocked position, it must be released from the inside before the bolt can be returned to the locked position. As viewed in FIGS. 3, 4, and 5, when the bolt is withdrawn by turning knob 21 clockwise, plate 118 is moved with the bolt by pin 76. Dog 122, secured to plate 118 by pins 123, contacts arm 124 which is pivotally attached to block 125*a* on shaft 125 and beings to turn the shaft. As this occurs, arm 126 is also turned counterclockwise as seen in FIG. 8, which in turn bears inwardly on the upper end of trip arm 127, which extends through shaft portion 111 of the knob. The trip arm brings knob 110 in with it against flat spring 128. This movement of arm 124 by dog 122 is shown in FIGS. 10A and 10B.

When the bolt is about ¾ withdrawn, arm 124 clears the top of dog 122 and is pulled back into the position shown in FIG. 10C by coil spring 129, the opposite ends of which are connected to shaft 125 and the underside of hub 130, respectively, and against the force of spring 125*b*.

Just prior to this point, trip arm 127 having reached the bottom of slot 131, as seen in FIG. 9, is pulled to the right by tension spring 132 into slot 133. This action, then, holds locking arm 45 on bypass, as seen in FIG. 5, and the bolt cannot be thrown out to lock. In addition, arm 23*b* is caught by hook 134 on the left hand end of lock back lever 135, as seen in FIG. 20. Therefore, when the bolt is completely withdrawn, as above described, the mechanism will appear, as seen in FIG. 20, with the bolt secured back against relocking by hook 134 having dropped over and back of arm 23*b*. Release knob 110 will have pressed flat spring 128 down, the upper end of trip arm 127 will be trapped in slot 133 and held there by spring 132, one end of which is connected to the lower end of the trip arm. Bolt control arm 45 is held in bypass position by shaft 111 and arm 124 will be positioned to the left of dog 122, as seen in FIG. 10C.

The lock includes a night latch to insure that the lock cannot be opened even if someone has the combination. To set the night lock from inside of the door, release knob 110 is turned clockwise, as shown by the arrow, so as to bring trip arm 127 into alignment with slot 131, as seen in FIG. 9. This allows flat spring 128, as seen in FIGS. 7 and 8, to move shaft 111*a* and knob 110 outwardly. When this occurs, trip arm 127 will push catch lever 135 outwardly toward the inside of the lock, as seen in FIGS. 3 and 7, thereby releasing arm 23*b* from hook 134. Knob 21 is now free to turn counterclockwise and return the bolt to the locked position.

Night latch knob 140 is mounted on shaft 142 which passes through U-shaped bracket 141 for rotating U-shaped member 116. Rotating the knob counterclockwise to the position shown in FIG. 5 moves member 116 into position (FIG. 5) to block arm 23*b* and the bolt from movement to the right.

To release the night latch, the user on the inside of the door has only to move release knob 110 inwardly, which brings trip lever 127 inwardly in slot 131 into alignment with slot 133 where it is pulled again to the right by spring 132. This action carries rod 144 to the right and causes L-shaped hook 145 to engage U-shaped yoke 146 and rotate member 116 to the position shown in FIG. 20. The night lock is then off and locking arm 45 is automatically put on bypass, as seen in FIG. 5. Pins 148 on the end of the trip arm 127 contain rod 144 in its position on the end of arm 127.

As shown in FIG. 14, each dial has a spring member 150 mounted with one end held and the other positioned to engage spaced holes 151 as the dial is rotated. The spring can be easily forced out of the holes, but in doing so the operator will feel it and know he has passed another number on the dial.

The embodiment of the lock of this invention is a padlock is shown in FIGS. 21–29. It includes housing 160 and bolt 161, which in this embodiment is in the form of a U-shaped shackle that is typical of padlocks. Four tumblers A, B, C, and D are provided instead of the six of the previously described embodiment. Again the tumblers are of the same construction. An exploded view of one is shown in FIG. 25. It includes tumbler barrel 162 having fence 163 attached thereto. Stub shaft 164 extends from the barrel along its longitudinal axis to engage opening 165 in back 160*a* of housing 160 to help support the tumbler for rotation. Fixed plate 159 provides the other support for the tumblers, having openings through which they extend.

Flange 166 is attached to the barrel and has ten equal flats 166*a* on its periphery. The dial assembly includes barrel driving member 168 which has cavity 169 that is provided with ten internal flats 169*a*. The driving member is designed to receive flange 166 in cavity 169 with their flats engaging to prevent relative rotation therebetween so that rotation of the driving member will rotate the barrel. Bolt 170 extends through opening 171 in the driving member and engages a tapped hole (not shown) in the barrel. Cylindrical portion 172 of the driving member provides a housing for spring 173. One end of the spring engages a shoulder in the cylindrical portion and the other end engages the head of bolt 170 to allow driving member 168 to be pulled away from engagement with flange 166 of the barrel by compressing the spring. When moved apart, the driving member can be rotated relative to the barrel to change the combination of the lock.

Dial 174 is attached to spring housing 172 so that rotation of the dial is imparted to driving member 168 through drive pin 168*a*, which engages hole 174*a* in the dial. Cap 175 engages internal threads in housing 172 to hold the dial in position on the spring housing.

The tumblers extend through openings 177 in gate plate 178. Intersecting each opening is gate 179 which will pass over fence 163 on the tumbler barrel to allow the gate plate to be moved to open the lock. This can occur, of course, only when the tumblers have been positioned according to the combination of the lock.

As with the other embodiment, means are provided to prevent anyone from feeling out the combination. In this embodiment, a plurality of notches 177*a*, one for each number on the dial, are placed in the gate plate around each opening 177. These notches are designed to engage fences 163 and hold the tumblers from rotation when the gate plate is forced toward the fences in an effort to feel the position of the gates relative to the fences.

Means are provided to hold the bolt or shackle locked in the housing. As best seen in FIGS. 22, 28 and 29, each leg of the shackle has transverse groove 180 in which is located locking bar 181, when the lock is closed as shown in FIGS. 22 and 29. Spring 182 has one end attached to fixed plate 159 and the other in engagement with the locking bar to hold the bar in the grooves and to urge the bar toward the grooves at all times. Each groove has lip 180*a* that will extend over the bar sufficient to hold the bar in the groove when a force is applied to the shackle with the bar in place.

To open the lock the dials are set according to the combination. Means are provided to move the gate plate and open the lock. In the embodiment shown, gate plate 178 has fingers 184 that are positioned to move the locking bar out of grooves 180, as the plate is moved over the tumblers along their longitudinal axes. The means for moving the gate plate include cam plate 186 located adjacent back 160*a* of the housing. It has cams 187, two on each side to engage the gate plate and wedge it away from the back of the lock along the axis of the tumblers. Thus, it is raised against compression spring 218 which passes through clearance hole 218*a* of fixed plate 159, which is best seen in FIGS. 22 and 24. The fixed plate is not shown in FIG. 22.

The cam plate is moved by plunger 188 that extends outside the lock housing. It includes portion 188*a* that extends through an opening in the housing and portion 188*b* of reduced diameter that extends through an opening in lug 189 attached to the cam plate. Spring 190 located between lug 189 and the bottom of a spring well in portion 188*a* of the plunger urges the plunger away from the lug to the extent allowed by retaining ring 191. Spring 192 located between the bottom of the housing and the cam plate urges the cam plate toward the top of the housing to the extent allowed by stops 193. The relative strengths of the springs is such that when the proper combination has been dialed and the gate plate can move, spring 190 will compress spring 192 and cause the cam plate to move with the plunger. When the cam plate cannot move, spring 190 will compress and allow the plunger to be acutated without placing any greater force on the cam and gate plates then what is required to compress the spring.

The gate plate is guided in its movement along the axes of the tumblers by shaft 195 and guide sleeve 196. Guide sleeve 196 extends up through clearance hole 159*a* in fixed plate 159. The shaft extends between back side 160*a* and housing cover 183 and guide sleeve 196 is attached to the gate plate and slides on the shaft.

When locking bar 181 is forced out of grooves 180, spring 197 (FIG. 23) on guide pin 198 moves the shackle to the position shown in FIG. 27. The locking bar is clear of the groove but this is just the first step in opening the lock. In each leg of the shackle below the grooves is a notch 200. Positioned to engage the notches are fingers 201 attached to zero plate 202. This zero plate functions in the same manner as the zero plate of the previous embodiment in that it requires the dials to be returned to a predetermined position, i.e., zero, before the lock can be opened. Here again, the purpose is to remove the combination before the lock is opened. The plate, as shown in FIG. 26, extends between the tumbler driving members and has portions of increased width 202*a* that will not pass the rims of the driving members and move forward until the tumblers are rotated to position flats 169*b* (FIG. 25), as shown in FIG. 26, so that the zero plate can move forward. As it moves forward, fingers 201 are moved out of engagement with notches 200 by inclined surface 201*a* engaging openings 203 in fixed plate 159. This releases the shackle for movement out of the housing until at least one leg clears the housing in the conventional manner.

Located above the zero plate is combination change plate 205. This plate moves with the zero plate. It has arms 206 that are positioned as shown in FIG. 26, except when the zero plate is moved forward by the shackle. In the position shown, arms 206 prevent the driving member from being moved out of engagement with flange 166 of the tumbler barrel. This prevents the combination from being changed by anyone not knowing the present combination. When the present combination is dialed, however, the zero plates can be moved forward by the movement of the shackle to the position shown in FIG. 27 and the combination can be changed. During this operation, of course, it is necessary to hold the plunger down so that the gates will be in engagement with the fences on the tumblers. Compression spring 211 rests in a well in zero plate 202 and maintains change plate 205 pressed up against case top 183 at all times, as viewed in FIGS. 27, 28, and 29. After the shackle clears the housing, fingers 201 are free to allow zero plate 202 to drop down and carry change plate 205 back to anti-change position, as seen in FIGS. 26 and 29. Thus, the combination cannot be changed in either a locked or unlocked position. Of course, guide 196 works vertically and is otherwise stationary. Therefore, when plates 205 and 202 move forward, guide clearance slots 213 in the two plates, as seen in FIG. 26, allow for this movement.

It is one of the features of this invention to provide a lock that can be opened in the dark or by a blind person. To accomplish this, resilient means are provided to releasably hold each dial in each position, thereby requiring noticeable torque to move each dial from number to number.

In the embodiment shown, U-shaped spring wires 207, seen in FIG. 26, secured to fixed plate 159 by hold down bars 208 and screws 208*a* press inwardly against flats 166*a* below the rim of driving member 168 and cause the dial to stop accurately with a positive feel at each of the 10 provided stations. Blind or night dialing is thus accomplished with ease equal to that of normal day dialing by counting off the number of places called for by each number of the combination.

When the combination has been properly dialed on the plunger depressed to accomplish the first stage of opening, then each dial is turned counterclockwise and will automatically stop at zero as projection 217*a* of the dial comes to rest against pin 217, as viewed in FIG. 21.

This embodiment of the lock of this invention can also be opened using a master combination should the current combination be forgotten. In this embodiment, master starting point pins 209, as seen in FIGS. 23, 28, and 29, are mounted in back 160*a* of housing 160 for axial movement toward each tumbler barrel. Each pin is in circumferential alignment with shallow depressions 210 on the ends of tumbler barrels. By placing a finger on one pin at a time while the dial is turned to the right or to the left, the user can feel the pin drop into depression 210 and stop there. When all pins have been thus dropped into the depressions, the number showing on each dial is added to the master combination number for that dial. For example, if the master combination is 8328 and the pins drop into the depressions at 5374, the two are added, thus 8 and 5 are 13, 3 and 3 are 6, 2 and 7 are 9, 8 and 4 are 12. Dropping the surplus digit at the left, the number 3692 is the number that would open the lock, and would be the current combination then on the lock.

As viewed in FIGS. 23 and 24, access holes 214 in cam plate 186 will line up with bolt holes 215 and bolt access holes 215*a* in back 160*a* of the housing when the lock is dialed to open and plunger 188 pushes cam plate 186 to move gate plate 178. Only in this position can an allen wrench be inserted through access holes 214 to turn screws 216, which hold the housing assembled, to disassemble or reassemble the lock. This can be done only by the person knowing the combination.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A combination lock comprising a bolt, means for moving the bolt between a locked and an unlocked position, a gate plate, means mounting the plate for movement along a line perpendicular to the plate between a first position holding the bolt in its locked position and a second position allowing the bolt to be moved to its open position, a plurality of openings in the gate plate, a plurality of tumblers mounted for rotation in the openings, having exposed dials for positioning the tumblers in accordance with a combination, a fence carried by each tumbler and a gate intersecting each opening in the plate to receive the fence and allow the plate to move along the longitudinal axis of the tumblers only when all of the tumblers are positioned in accordance with the combination of the lock.

2. The combination lock of claim 1 further provided with means for locking the tumblers against rotation when the bolt is urged toward its unlocked position.

3. The combination lock of claim 1 further provided with means for allowing the bolt to be moved only a limited distance toward its unlocked position after which the tumblers must be reset to another position before the bolt can be moved to its unlocked position to insure that the combination is not left exposed when the lock is open.

4. The lock of claim 1 in which the gate plate includes a cam attached to the plate, and the bolt moving means includes a bolt control member for engaging the cam when the bolt is moved from its locked position toward its unlocked position, said cam being positioned to hold the bolt from moving to its unlocked position unless the tumblers have been positioned to the proper combination thereby allowing the cam to move out of holding position by moving the plate to its second position.

5. The lock of claim 4 in which the bolt control member is pivotally mounted for movement between a position to engage the cam and a position for bypassing the cam and the lock further includes means located on the opposite side of the lock from the exposed dials of the tumblers for moving the member to its cam bypassing position to allow the lock to be opened from this side at any time.

6. The lock of claim 1 in which each tumbler includes a dial portion and a barrel portion to which the fence is connected, and means connecting the barrel portion to the dial portion for rotation therewith, said connecting means being releasable when the fences of all of the tumblers are positioned in the gates of the gate plate to allow any or all of the dial portions to be set to a different number to thereby change the combination.

7. The lock of claim 6 further provided with means for opening the lock when the combination is lost comprising a spare combination plate mounted parallel to the gate plate and having a plurality of openings through which the plurality of tumblers extend, each of said openings being large enough to also receive the fence carried by the tumbler located therein, a stop located in each opening to engage the fence and limit the rotation of the tumbler, and means for moving the spare combination plate into position for the stops to limit the rotation of the tumblers so that the fence of each tumbler can be rotated in one direction into engagement with the stop after which rotation of the tumblers through a predetermined angle will position the fences on the tumblers to move through the gates of the gate plate and allow the lock to be opened.

8. The lock of claim 7 further provided with means mounting the stops in the openings for movement around the periphery of the opening and means for locking the stop against such movement when in the desired position and for releasing the stop for movement to another position to change the spare combination when desired.

9. The lock of claim 1 in which each tumbler has a surface configuration that is positioned in a preselected relationship to the fence that can be used to open the lock should the combination be unavailable.

10. The lock of claim 1 further provided with means located on one side of the lock to prevent the lock from being opened from the other side and means to automatically release said means when the lock is opened from said one side.

11. A combination lock comprising a bolt movable between a locked and an unlocked position, means for holding the bolt in the locked position, a gate plate, means mounting the plate for movement along a line perpendicular to the plate between a first position allowing the bolt holding means to hold the bolt in the locked position and a second position that moves the bolt holding means out of holding engagement with the bolt to allow the bolt to move to its unlocked position, a plurality of openings in the gate plate, a plurality of tumblers mounted for rotation in the openings and having exposed dials for positioning the tumblers in accordance with a combination, a fence carried by each tumbler and a gate intersecting each opening in the plate to receive the fence and allow the plate to move along the longitudinal axis of the tumblers to its second position only when all of the tumblers are positioned in accordance with the combination of the lock and means to move the gate plate to its second position to release the bolt from the holding means for movement to its unlocked position.

12. The combination lock of claim 11 further provided with means for locking the tumblers against rotation when the bolt is urged toward its unlocked position.

13. The combination lock of claim 11 further provided with means for allowing the bolt to be moved only a limited distance toward its unlocked position after which the tumblers must be reset to another position before the bolt can be moved to its unlocked position to insure that the combination is not left exposed when the lock is open.

14. The lock of claim 11 in which the gate plate moving means includes cam means movable relative to the plate to move the plate to its second position and means operable outside the lock for moving the cam means to move the gate plate to its second position.

15. The lock of claim 14 further provided with resilient means urging the gate plate toward its first position and the means for moving the cam means including resilient means for transmitting the moving force to the cam means to allow the moving means to be operated without moving the cam means when the tumblers are not in position to allow movement of the gate plate to its second position.

16. The lock of claim 11 in which each tumbler includes a dial portion and a barrel portion to which the fence is connected, and means connecting the barrel portion to the dial portion for rotation therewith, said connecting means being releasable when the fences of all of the tumblers are positioned in the gates of the gate plate to allow any or all of the dial portions to be set to a different number to thereby change the combination.

17. The lock of claim 11 in which each tumbler has a surface configuration that is positioned in a preselected relationship to the fence that can be used to open the lock should the combination be unavailable.

18. The lock of claim 17 in which the surface configuration is a cavity and the lock is provided with pins movable from outside the lock to engage the cavities and position the tumblers in a preselected position from which they can be moved in accordance with a master combination to open the lock when the current combination is forgotten.

19. The lock of claim 11 further provided with means for stopping the rotation of each tumbler in a known position and means for releasably holding the tumbler in each of the plurality of positions to which the dial may be moved so that the torque required to move the tumbler to successive positions is sufficient for an operator to feel the movement from position to position to allow the tumblers to be positioned to open the lock even though the dials cannot be seen by the operator.

20. The lock of claim 19 in which the tumbler holding means includes a plurality of flat surfaces on each tumbler and resilient means engaging one of the flat surfaces in each position of the tumbler to resist rotation of the tumbler from such position.

21. The lock of claim 14 provided with a housing for the lock mechanism and in which the means for moving the cam means includes a plunger assembly having one end attached to the cam means and the other end extending externally of the lock housing so that moving the plunger axially will urge the cam means to move the gate to open the lock.

22. The lock of claim 21 in which the housing includes a plurality of parts held together by releasable means located inside the assembled housing, an opening in the housing providing access to the holding means, and means carried by the cam means to close the access opening except when the cam means has moved the gate plate to its second position.

23. A combination lock comprising a bolt movable between a locked and an unlocked position, means for holding the bolt in the locked position, a plurality of tumblers having exposed dials for positioning the tumblers in accordance with a first combination, means for releasing the bolt holding means when the tumblers have been so positioned, and means for holding the bolt from moving to its unlocked position until the tumblers have been moved by the dials to a second combination to prevent the combination from being exposed while the lock is open.

24. The lock of claim 23 in which all of the dials are returned to zero to form the second combination.

25. The lock of claim 23 further provided with means to stop the rotation of the dials at a preselected number and with means to releasably resist rotation of each dial from each number to allow the first combination to be dialed by feel.

* * * * *